US006533264B1

(12) United States Patent
Tranquilla

(10) Patent No.: US 6,533,264 B1
(45) Date of Patent: Mar. 18, 2003

(54) CONSTANT SPACE DOCUMENT FEEDER

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 161 days.

(21) Appl. No.: 09/780,329

(22) Filed: Feb. 9, 2001

(51) Int. Cl.[7] ..... B65H 5/00
(52) U.S. Cl. ..... 271/10.02; 271/10.09; 271/10.11
(58) Field of Search ..... 271/10.01, 10.09, 271/10.11, 10.02, 4.01, 4.08, 4.1, 4.02

(56) References Cited

U.S. PATENT DOCUMENTS 5,575,466 A * 11/1996 Tranquilla ..... 271/10.09 X
5,848,784 A * 12/1998 Tranquilla ..... 271/10.09 X
6,076,821 A * 6/2000 Embry et al. ..... 271/10.01
6,224,049 B1 * 5/2001 Hosking et al. ..... 271/10.11 X

* cited by examiner

*Primary Examiner*—David H. Bollinger
(74) *Attorney, Agent, or Firm*—Lise A. Rode; Mark T. Starr

(57) ABSTRACT

A method and system provide for generating a predetermined feed spacing between a first document and a second document. The method includes the steps of determining an adjustment time period, and reducing a feed wheel speed to an adjustment speed. The feed wheel transports the documents between a document stack and a transport wheel. The method further provides for increasing the feed wheel speed after the adjustment time period has expired such that the trailing edge of the first document and the leading edge of the second document have the predetermined feed spacing. Determining the adjustment time period in conjunction with variable control of the feed wheel provides and enhanced approach to feed spacing unachievable through conventional approaches.

20 Claims, 1 Drawing Sheet

CONSTANT SPACE DOCUMENT FEEDER

FIELD OF INVENTION

The present invention generally relates to document feeders. More particularly, the present invention relates to a method and system for generating a predetermined feed spacing between a first document and a second document in a document feeder.

DISCUSSION

Document processing is a function performed by a wide variety of devices such as check processors, copiers, fax machines, printers, automated teller machines, and scanners. In all of these devices, typically one or more feed wheels will retrieve documents from a document stack and transport them along a given feed path. Often, a separator or retarder will be positioned on the opposite side of the document in order to ensure that the documents are retrieved one-by-one from the document stack.

One or more transport wheels are typically disposed farther along the feed path in order to transport the document to the desired location. While the above-described feeder wheel/separator mechanism is often effective in preventing feed overlap, sometimes parameters such as humidity, document weight, and document texture continue to cause feed overlap. To further address feed overlap, conventional document feeders typically drive the transport wheel at a higher speed than the feeder wheel. The speed differential is intended to cause a space to be developed between the two documents. This space is normally required for actuating pocket selector gates, advancing microfilm, or processing other information. Thus, normally the separator holds back the second document until the trailing edge of the first document leaves the feeder nip. Occasionally, however, it has been observed that the second document will still feed too soon resulting in overlap of consecutive documents. Depending on the amount of overlap, the higher speed of the transport wheels may still be able to separate these documents. The resulting space, however, maybe too small to allow satisfactory operation of pocket selector gates, for example. It is therefore desirable to provide a mechanism for eliminating overlap between subsequent documents in a document feeder.

Another concern relates to the insertion of a constant feed spacing between the documents. In this regard, it is important to note that the above-described feeder wheel/transport wheel speed differential results in feed spacings that are proportional to the length of the second document. This increased space for longer documents is unnecessary and decreases throughput. It is therefore also desirable to provide a control system capable of inserting a predetermined feed spacing between documents regardless of document length.

The above and other objectives are provided by a method for generating a predetermined feed spacing between a first document and a second document in accordance with the principles of the present invention. The method includes the steps of determining an adjustment time period, and reducing a feed wheel speed to an adjustment speed. The feed wheel transports the documents between a document stack and a transport wheel. The method further provides for increasing the feed wheel speed after the adjustment time period has expired, such that the trailing edge of the first document and the leading edge of the second document have the predetermined feed spacing. Reducing, the feed wheel speed for a variable adjustment time period provides an enhanced approach to constant feed spacing unachievable through conventional approaches.

The present invention further provides a method for determining an adjustment time period. The method includes the step of determining a desired change in feed spacing between a first document and a second document based on an initial feed spacing and a predetermined feed spacing. A wheel speed difference is also determined based on a transport wheel speed and an adjustment speed of a feed wheel, where the feed wheel transports the documents between a document stack and the transport wheel. The method further provides for determining the adjustment time period based on the desired change in feed spacing and the wheel speed difference.

Further in accordance with the present invention, a document feed control system includes a feed wheel controller and an adjustment module. The feed wheel controller reduces a feed wheel speed to an adjustment speed, where the feed wheel transports a first document and a second document between a document stack and a transport wheel. The feed wheel controller increases the feed wheel speed after an adjustment time period has expired such that a trailing edge of the first document and a leading edge of the second document have a predetermined feed spacing. The adjustment module determines the adjustment time period.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute part of this specification. The drawings illustrate various features and embodiments of the invention, and together with the description serve to explain the principles and operation of the invention.

BRIEF DESCRIPTION OF THE DRAWINGS

The various advantages of the present invention will become apparent to one skilled in the art by reading the following specification and appended claims, and by referencing the following drawings, in which:

DETAILED DESCRIPTION OF THE PREFERRED EMBODIMENTS

Figure 1:
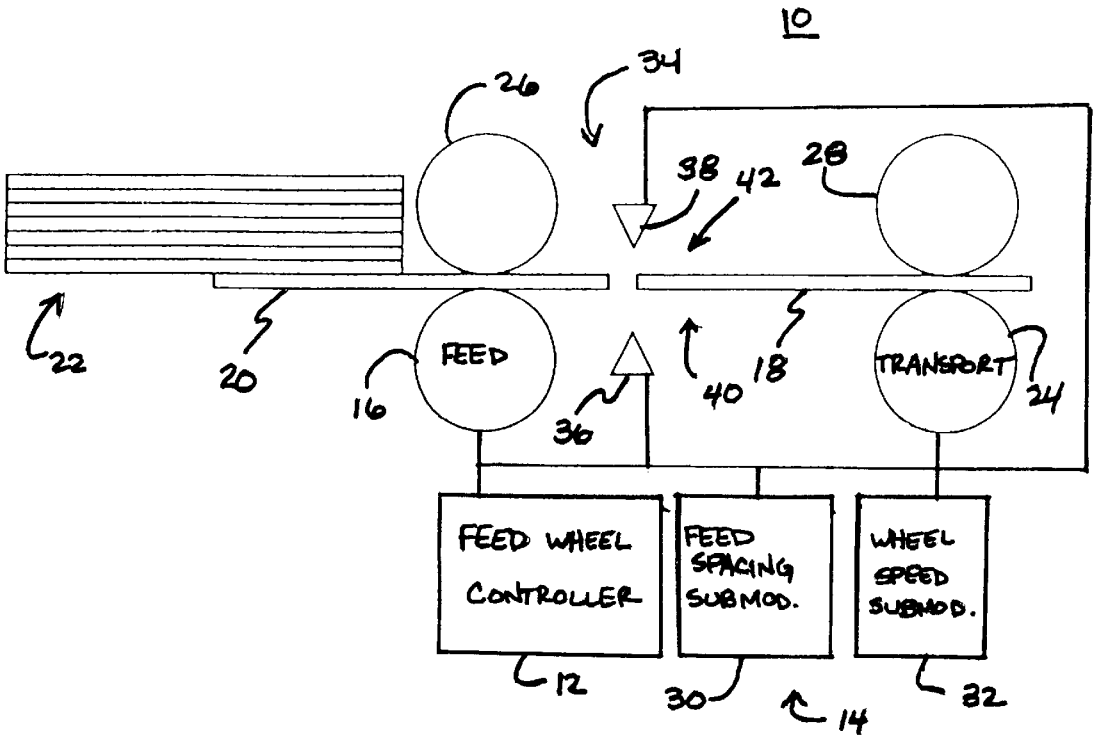
FIG. 1 is a block diagram showing a document feeder control system in accordance with the present invention.

Turning now to FIG. 1, a document feeder control system 10 is shown in accordance with the present invention. While the control system 10 will be primarily described with respect to a financial document processor (not shown), it is important to note that the present invention is not so limited. Thus, the control system 10 can be used in devices including, but not limited to, copiers, fax machines, computer printers, automatic teller machines, and document image scanners.

It can be seen that a feed wheel 16 transports a first document 18 and a second document 20 between a document stack 22 and a transport wheel 24. It is important to note that while a single feed wheel 16 is shown in the side view of FIG. 1, multiple feed wheels may be used depending on the width of the documents and the particular application.

The same is true for the transport wheel 24. The control system 10 generally includes a feed wheel controller 12 and an adjustment module 14. The feed wheel controller 12 reduces the feed wheel speed to an adjustment speed. The feed wheel controller 12 increases the feed wheel speed after an adjustment time period has expired such that a trailing edge of the first document 18 (TE1) and a leading edge of the second document 20 (LE2) have a predetermined feed spacing. The adjustment module 14 determines the adjustment time period. It can further be seen that a separator 26 (or retarder) is either fixed or rotates at a slower speed than the feed wheel 16. Similarly, an idler 28 is positioned adjacent to the transport wheel 24 on the other side of the documents. The purpose of the separator 26 is to prevent overlap between the first document 18 and the second document 20.

It is preferred that the adjustment module 14 has a feed spacing submodule 30 for determining a desired change in feed spacing between the first document 18 and the second document 20 based on an initial feed spacing and the predetermined spacing. The adjustment module 14 further includes a wheel speed submodule 32 for determining a wheel speed difference based on the transport wheel speed and the adjustment speed of the feed wheel 16. Since both the transport wheel speed and the adjustment speed of the feed wheel 16 are generally known, the wheel speed submodule 32 may merely be a memory location containing the appropriate wheel speed difference value. Furthermore, since the predetermined feed spacing is also generally known, the feed spacing submodule 30 only requires an initial feed spacing value in order to make its determination of the desired change in feed spacing. It will therefore be appreciated that the desired change in feed spacing can be represented as $\Delta d$ and the wheel speed difference can be represented as $\Delta v$. It will further be appreciated that dividing $\Delta d$ by $\Delta v$ provides the amount of time at which the feed wheel 16 must be driven at the lower speed to obtain $\Delta v$. Thus, the adjustment module 14 determines the adjustment time period based on the desired change in feed spacing $\Delta d$ and the wheel speed difference $\Delta v$.

It is important to note that the submodules 30,32 of the adjustment module 14 are illustrated in separate boxes for purposes of discussion. In fact, the functions of the adjustment module 14 can be implemented using any combination of software and/or hardware techniques well known in the art.

It will further be appreciated that the preferred control system 10 further includes an edge detection system 34 for determining the initial feed spacing. The edge detection system 34 has a light transmitter 36 and a light receiver 38. The light transmitter 36 is positioned on a first side 40 of the first and second documents 18,20 for transmitting a light signal to the first side 40 of the documents 18,20. The light receiver 38 is positioned on a second side 42 of the first and second documents 18,20 for receiving light transmitted by the transmitter 36. The receiver 38 therefore generates a detection system based on received light. It is important to note that the first and second sides 40,42 need not be defined as shown. Thus, the transmitter 36 and the receiver 38 may be reversed depending upon space and other design considerations.

Although any number of commercially available transmitter/receiver devices may be used, the transmitter 36 preferably transmits an infrared electromagnetic beam across the path of the documents. Thus, the receiver 38 measures the amount of electromagnetic energy that falls on its surface. The amount depends on the thickness of paper (or lack thereof) in the beam's path. Thus, the relatively fast change in energy caused by an edge is sufficient to determine that the edge has arrived at the detection point. This system for edge detection is commonly used today as a "double detector" in document sorters.

Figure 2:
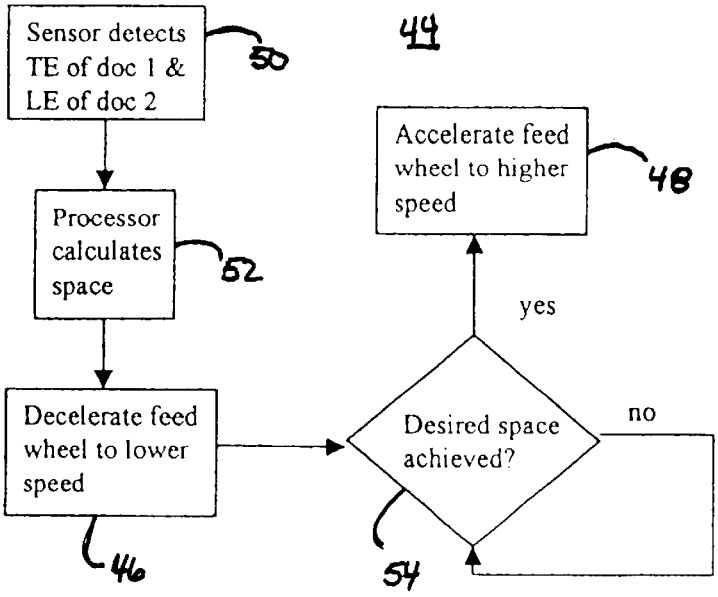
FIG. 2 is flowchart demonstrating a method for generating a predetermined feed spacing between a first document and a second document according to the present invention.

Turning now to FIG. 2, it will be appreciated that the present invention provides a method 44 for generating a predetermined feed spacing between a first document and a second document. Generally, an adjustment time period is determined at step 54 and the feed wheel speed is reduced to an adjustment speed at step 46. At step 48 the feed wheel speed is increased after the adjustment time period has expired, such that the trailing edge of the first document (TE1) and the leading edge of the second document (LE2) have the predetermined feed spacing. In one embodiment, the adjustment time period is determined by first determining a desired change in feed spacing between the first document and the second document. This desired change in feed spacing is determined based on the initial feed spacing and the predetermined feed spacing. As already discussed, a wheel speed difference is determined based on the transport wheel speed and the adjustment speed of the feed wheel. The adjustment time period is therefore determined based on the desired change in feed spacing $\Delta d$ and the wheel speed difference $\Delta v$. The method 44 shown in FIG. 2 achieves this by detecting TE1 and LE2 at step 50. At step 52 the initial feed spacing is determined based on detection of TE1 and LE2.

It will be appreciated that by measuring an amount of time between the detection of TE1 and the detection of LE2, the amount of time can readily be converted into the initial feed spacing. One approach to measuring the amount of time between detection of TE1 and detection of LE2 is to start a timer when TE1 crosses the detection point and stop the timer when LE2 crosses the detection point.

As already discussed, the wheel speed difference $\Delta v$ is generally known because the adjustment speed of the feed wheel is preselected. Thus, the rate at which the first document is distancing itself from the second document once the feed wheel is slowed down is also known. Thus, by subtracting the adjustment speed of the feed wheel from the transport wheel speed, the wheel speed difference can be readily determined. Furthermore, by subtracting the initial feed spacing from the predetermined feed spacing, the desired change in feed spacing $\Delta d$ can also be determined.

It will therefore be appreciated that after the (low speed time) has expired, the feeder wheel is accelerated back to a speed slightly less than the transport wheel. Normally, it is desirable to reach transport speed before the trailing edge of document two (TE2) leaves the feeder nip. In such case, the process can be repeated for subsequent documents. The present invention therefore provides a mechanism for generating a predetermined feed spacing between consecutive documents that is independent of document length.

Those skilled in the art can now appreciate from the foregoing description that the broad teachings of the present invention can be implemented in a variety of forms. Therefore, while this invention can be described in connection with particular examples thereof, the true scope of the invention should not be so limited since other modifications will become apparent to the skilled practitioner upon a study of the drawings, specification and following claims.

What is claimed is:

1. A method for generating a predetermined feed spacing between a first document and a second document, the method comprising the steps of:

determining an adjustment time period;

reducing the speed of a feed wheel to an adjustment speed, the feed wheel transporting the documents between a document stack and a transport wheel; and increasing the feed wheel speed after the adjustment time period has expired such that the trailing edge of the first document and the leading edge of the second document have the predetermined feed spacing.

2. The method of claim 1 further including the steps of:

determining a desired change in feed spacing between the first document and the second document based on an initial feed spacing and the predetermined feed spacing;

determining a wheel speed difference based on a transport wheel speed and the adjustment speed of the feed wheel; and determining the adjustment time period based on the desired change in feed spacing and the wheel speed difference.

3. The method of claim 2 further including the steps of:

detecting a trailing edge of the first document at a detection point along a feed path of the documents;

detecting a leading edge of the second document at the detection point; and determining the initial feed spacing based on detection of the trailing edge and the leading edge.

4. The method of claim 3 further including the steps of:

measuring an amount of time between the detection of the trailing edge and the detection of the leading edge; and converting the amount of time between the detection of the trailing edge and the detection of the leading edge into the initial feed spacing.

5. The method of claim 4 further including the steps of:

starting a timer when the trailing edge crosses the detection point; and stopping the timer when the leading edge crosses the detection point.

6. The method of claim 2 further including the step of selecting the adjustment speed of the feed wheel.

7. The method of claim 2 further including the step of subtracting the initial feed spacing from the predetermined feed spacing.

8. The method of claim 2 further including the step of subtracting the adjustment speed of the feed wheel from the transport wheel speed.

9. The method of claim 2 further including the step of dividing the desired change in feed spacing by the wheel speed difference.

10. The method of claim 2 further including the step of dividing the desired change in feed spacing by the wheel speed difference.

11. The method of claim 1 further including the step of increasing the feed wheel speed before detection of a trailing edge of the second document.

12. The method of claim 1 further including the step of selecting the adjustment speed of the feed wheel.

13. A method for determining an adjustment time period, the method comprising the steps of:

determining a desired change in feed spacing between a first document and a second document based on an initial feed spacing and a predetermined feed spacing;

determining a wheel speed difference based on a transport wheel speed and an adjustment speed of a feed wheel, the feed wheel transporting the documents between a document stack and the transport wheel; and determining the adjustment time period based on the desired change in feed spacing and the wheel speed difference.

14. The method of claim 13 further including the steps of:

detecting a trailing edge of the first document at a detection point along a feed path of the documents;

detecting a leading edge of the second document at the detection point; and determining the initial feed spacing based on detection of the trailing edge and the leading edge.

15. The method of claim 14 further including the steps of:

measuring an amount of time between the detection of the trailing edge and the detection of the leading edge; and converting the amount of time between the detection of the trailing edge and the detection of the leading edge into the initial feed spacing.

16. The method of claim 15 further including the steps of:

starting a timer when the trailing edge crosses the detection point; and stopping the timer when the leading edge crosses the detection point.

17. A document feeder control system comprising:

a feed wheel controller for reducing the speed of a feed wheel to an adjustment speed, the feed wheel transporting a first document and a second document between a document stack and a transport wheel;

said feed wheel controller increasing the feed wheel speed after an adjustment time period has expired such that a trailing edge of the first document and a leading edge of the second document have a predetermined feed spacing; and an adjustment module for determining the adjustment time period.

18. The control system of claim 17 wherein the adjustment module includes:

a feed spacing submodule for determining a desired change in feed spacing between the first document and the second document based on an initial feed spacing and the predetermined feed spacing;

a wheel speed submodule for determining a wheel speed difference based on a transport wheel speed and the adjustment speed of a feed wheel;

said adjustment module determining the adjustment time period based on the desired change in feed spacing and the wheel speed difference.

19. The control system of claim 18 further including an edge detection system for determining the initial feed spacing.

20. The control system of claim 19 wherein the edge detection system includes:

a light transmitter positioned on a first side of the first and second documents for transmitting a light signal to the first side of the documents;

a light receiver positioned on a second side of the first and second documents for receiving light transmitted by the transmitter;

said receiver generating a detection signal based on received light.

* * * * *